US006173478B1

(12) United States Patent
Patelli et al.

(10) Patent No.: US 6,173,478 B1
(45) Date of Patent: Jan. 16, 2001

(54) DEVICE AND METHOD FOR EQUALIZING THE SUPPLY TO A CARDER OF TEXTILE FIBRES WHICH ARE IN THE FORM OF A MAT

(75) Inventors: Silvano Patelli; Giovanni Battista Pasini, both of Palazzolo Sull'Oglio (IT)

(73) Assignee: Marzoli S.p.A., Palazzolo Sull'Oglio (IT)

( * ) Notice: Under 35 U.S.C. 154(b), the term of this patent shall be extended for 0 days.

(21) Appl. No.: 09/352,870

(22) Filed: Jul. 13, 1999

(30) Foreign Application Priority Data

Jul. 14, 1998 (IT) ..... MI98A1618

(51) Int. Cl.[7] ..... D01G 15/40
(52) U.S. Cl. ..... 19/105
(58) Field of Search ..... 19/0.23, 0.24, 19/65 A, 97.5, 96, 98, 99, 105, 296, 204; 33/501.02, 501.03, 501.04; 73/159; 492/38, 39

(56) References Cited

U.S. PATENT DOCUMENTS 445,123 * 1/1891 McKnight ..... 492/39
2,730,770 * 1/1956 Higginbotham et al. ..... 492/39
4,776,065 * 10/1988 Rake et al. ..... 19/105
4,785,505 * 11/1988 Leifeld ..... 19/105
4,872,247 * 10/1989 Nakamura et al. ..... 29/125
4,955,266 * 9/1990 Staheli et al. ..... 19/105
5,052,080 * 10/1991 Grundler ..... 19/105
5,479,679 * 1/1996 Leifeld ..... 19/105
5,745,955 5/1998 Patelli et al. .
5,745,956 5/1998 Patelli et al. .
5,749,126 5/1998 Patelli et al. .
5,839,165 11/1998 Patelli et al. .

* cited by examiner

*Primary Examiner*—Michael A. Neas
*Assistant Examiner*—Gary L. Welch
(74) *Attorney, Agent, or Firm*—Oblon, Spivak, McClelland, Maier & Neustadt, P.C.

(57) ABSTRACT

Device for supply of a mat of fibers to a carder, by means of a slide, which ends by overlapping a plurality of pivoting tables, which are opposite a superimposed roller feed unit, in order to form a plurality of gaps, with individual and continual regulation of the speed of the rollers, according to the quantity of fibers which is present in their gap.

9 Claims, 3 Drawing Sheets

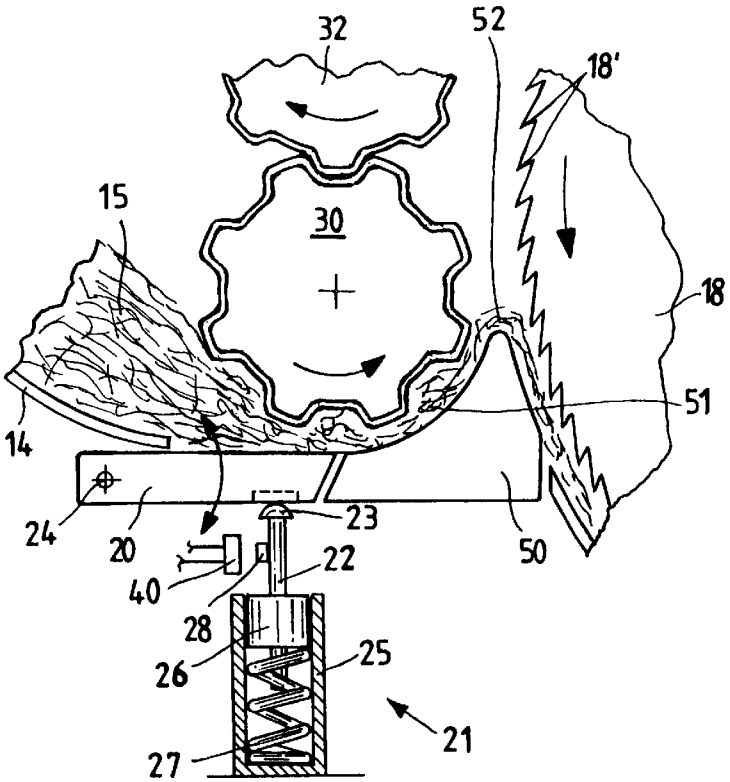
Fig.4
Fig.1
Related Art
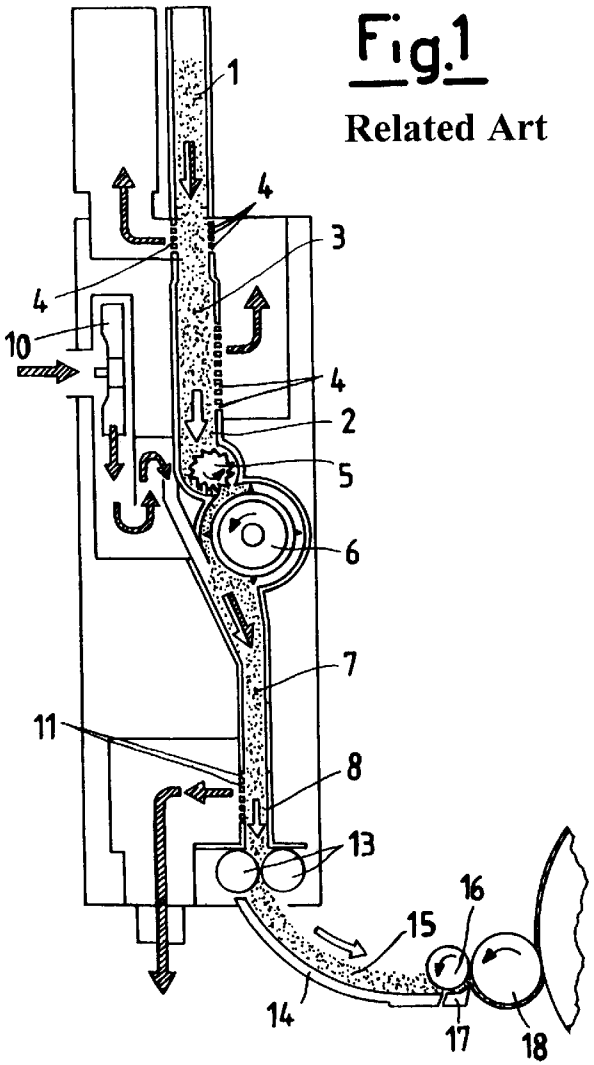

DEVICE AND METHOD FOR EQUALIZING THE SUPPLY TO A CARDER OF TEXTILE FIBRES WHICH ARE IN THE FORM OF A MAT

BACKGROUND OF THE INVENTION

1. Field of the Invention

The present invention relates to supply to carders, in which a thin layer of fibrous material is worked by a series of surfaces, which are provided with a large number of tips with a variety of shapes, inclinations and levels of stiffness, and are driven with motion relative to one another, by means of which the fibrous material is opened up into the form of individual fibres, the particles of dirt are eliminated, the fibres are mingled with one another, and a non-twisted strip of fibres is formed, to be sent to the successive processing stages.

2. Discussion of the Background

In its most general aspects, the operation of supply to a carder of the cotton-industry type is carried out according to the most significant aspects of the diagram illustrated in FIG. 1. The light-coloured arrows indicate the flow of flock fibres, whereas the dark arrows indicate the flow of the conveying and control air.

In general, the untreated material 1, which consists of flock fibres, is obtained from an opener, which is not shown in the figure. It is conveyed by means of pneumatic transport in a current of air, and is accumulated in the end part 2 of the descending duct 3 for intake of the fibres. The transport air is discharged via the apertures 4; as the fibrous material is deposited in the end part 2, it covers these apertures, and increases the pressure in the duct 3. Monitoring of the pressure value in the upper duct makes it possible to measure the level of filling of the chamber or end part 2. On the basis of the level of filling of the latter, there is regulation of the processing, and of the flock fibres conveyed from the preceding series of openers. If the carding unit consists of a plurality of carders in parallel, the flow of fibres which is conveyed from the opener unit upstream, to the carders downstream, is distributed preferentially to the carders, the ducts 3 of which are least filled, and which thus provide a smaller loss of load relative to the flow of fibres.

Downstream from the end part 2, there is disposed the supply cylinder 5, which supplies the flock fibres to the disintegrator cylinder 6, which breaks up the material. The two cylinders operate with rotation which is consistent with one another, in order to transfer the material to the duct 7 below.

The current of air in order to maintain the pressure in the lower chamber 8 at the end of the duct 7, is supplied by means of a blower 10, which supplies a flow of air tangentially relative to the disintegrator cylinder 6, which air is then discharged via the apertures 11. In the duct 7, there is installed a pressure switch, which controls the speed of rotation of the roller 5, such as to regulate the density of the fibres contained in the chamber 8, which form the mat supplied to the carder.

The base of the second descending duct 7 is equivalent to conventional storage of fibres in silos, in which the density of the fibres is controlled and regulated by pneumatic effect.

The set of discharge cylinders or lobar rollers 13, which rotate at a controlled speed, in order to regulate the output of fibres, discharges the fibres onto a slide 14, which supplies the fibres in the form of a mat 15 to the carder. The machine is provided with a supply roller 16, which controls the mat, and presses it against the supply table 17, and supplies a brush of mat to the actual carder. The first carding step is carried out by the opener cylinder 18, which is generally known as the taker-in.

The transverse dimension of the mat supplied is compatible wit h that of the carder processing cylinders; for carders of the cotton-industry type, this transverse dimension is in general between 0.7 and 1.5 metres, depending on the models, and it is essential that this mat is of a regular thickness and density along its entire length, such that the strip which is produced by the carder is processed in a homogeneous manner in the transverse direction.

The present invention relates more specifically to a system for supply to the opening cylinders or taker-in of a carder, in order to obtain a supply of flock fibres which is regular over a period of time, and is distributed homogeneously along the entire length of the carder, both over a period of time and in the cross-section of the conveying ducts, even when the density of the fibres varies.

According to the present state of the art, the technical problem of regularity over a period of time, of the quantity of fibres supplied to the carder, has been dealt with, for example, in U.S. Pat. No. 4,275,483 in the name of Robeson, by arranging the horizontal support shaft of the roller 16 on an oscillating system, which is opposite the fixed tables 17, and forms a guide for conveying the mat towards the taker-in. Depending on the raising thrust exerted by the mat on the roller 16, which is detected by a corresponding sensor to detect the displacements of the roller, the speed of the supply roller 16, i.e. the linear output of the mat, is then varied. This system is sensitive to the average density of the fibrous mass which passes moment by moment beneath the roller 16, but it does not detect in any way whether the fibrous material is well-distributed, and has a homogeneous density in a transverse direction along the entire width of the slide 14, or whether, in contrast, it is concentrated preferentially on one side of the slide or the other. In fact, it is not possible to prevent preferential paths in the descending ducts, although control of the density by means of the current of air in the two ducts 3 and 7 is designed to make the flow and the density of the fibrous flock material more regular.

The volume of fibres thus supplied to the carder, with its transverse irregularities, is worked with the same intensity of opening and cleaning, along the entire width of the cylinders, and for smaller thicknesses or lower densities this can be excessive, and for greater thicknesses or higher densities it can be insufficient. The carder is intrinsically unable to carry out mingling or homogenisation in a transverse direction of the fibres which are presented to the taker-in. If an irregularity of volume or density occurs at the start of the taker-in, at a specific transverse co-ordinate, in general this re-occurs at the same co-ordinate in the final doffer of the carder, thus giving rise to a strip which has an irregular transverse cross-section, depending on the excesses or lacks of material present in the transverse cross-section of the mat.

In addition to this disadvantage, there is irregular wear of all the fixed and mobile lined surfaces, as well as dirtying and irregular clogging of the linings.

SUMMARY OF THE INVENTION

The system according to the invention is designed to overcome these disadvantages and limitations; it consists of a device, the substantial characteristics of which are defined in the independent apparatus claim, and the preferred embodiments of which are defined in the claims which are dependent thereon, as well as of a method, the substantial characteristics of which are defined in the independent method claim, and the preferred embodiments of which are defined in the claims which are dependent thereon.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 illustrates a side, diagrammatical view of a related art cotton-industry type carder;

FIG. 4 illustrates an enlarged side view of a modified table structure according to the alternative embodiment depicted in FIG. 3.

DETAILED DESCRIPTION OF THE PREFERRED EMBODIMENTS

In order to illustrate more clearly the characteristics and advantages of the present invention, it is described by way of non-limiting example, with reference to a typical embodiment which is shown in FIGS. 2 to 5.

The embodiments in the figures show on an enlarged scale the area of supply of the carder, during transfer of the fibres to the taker-in 18.

Figure 2:
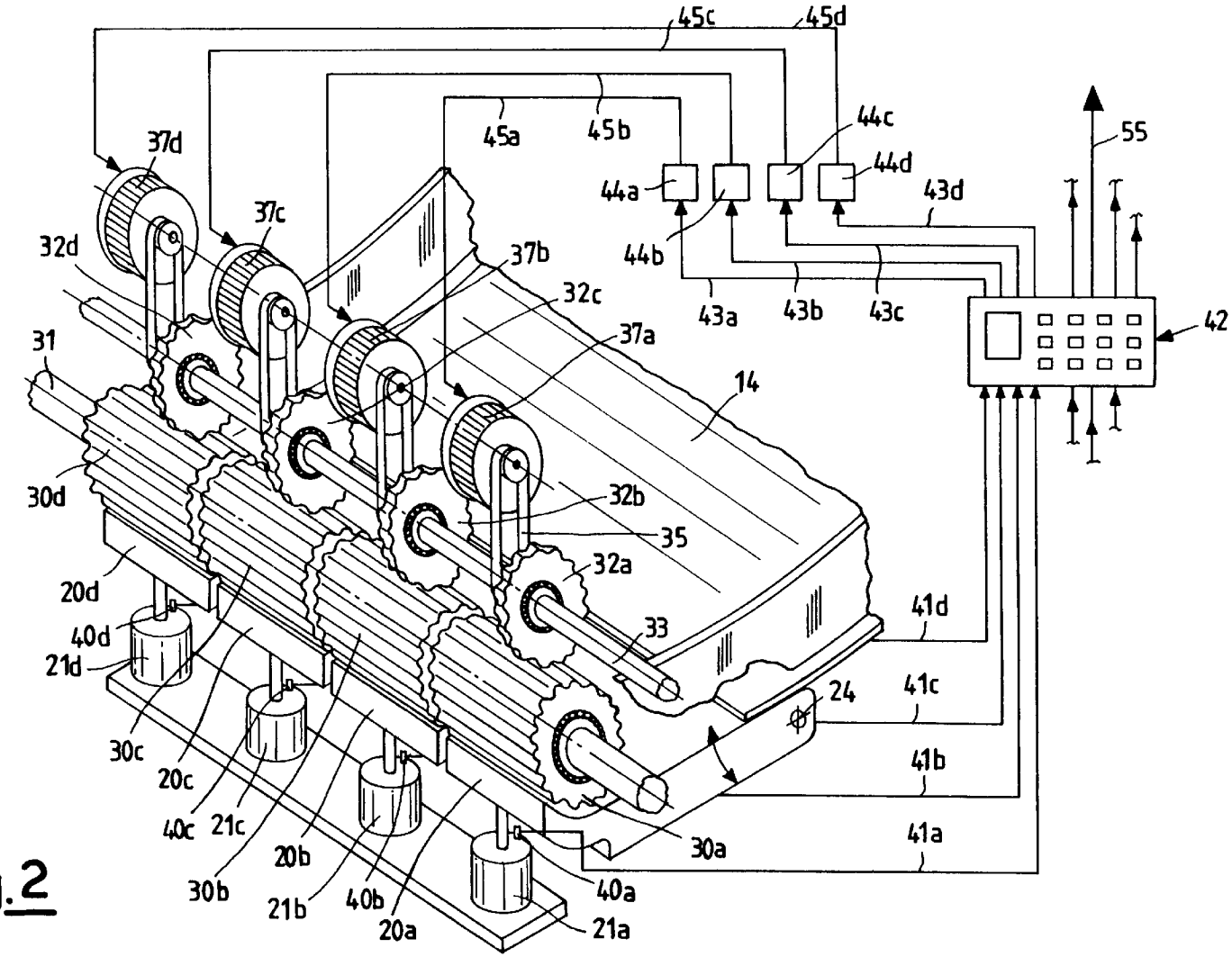
FIG. 2 illustrates a perspective view of an embodiment of a carder according to the present invention.

In the embodiment illustrated in FIG. 2, the slide 14 which conveys the mat to the carder supply unit, ends by overlapping a plurality of pivoting tables 20, which are aligned transversely, and are opposite a superimposed set of feed rollers 30, which have the same transverse dimension, and are also disposed transversely, such as to form a plurality of gaps between one another. The flow of fibres in the form of a mat 15 which is presented to the taker-in 18 of the carder, travels into the plurality of gaps between the row of tables 20 and the rollers 30, the speed of which is individually and continually regulated, according to the quantity of fibres present in the gap which corresponds to them, in order to ensure that the same output by weight of fibres passes through each gap. In the embodiment shown by way of example in the figures, the number of pivoting tables 20*a–d* is limited to four, although the transverse dimension of the slide 14, which corresponds to the width of the taker-in 18, can be subdivided into a number of conveyor gaps which varies from 3 to 8.

Each of the tables 20*a–d* is provided with a pressure unit 21*a–d* beneath, which thrusts its own table, in order to raise it against the corresponding roller 30*a–d*, with controlled force. In the detail in FIG. 4, this pressure unit 21 consists of calibrated springs, although it can consist of equivalent means, for example of pneumatic actuators, which are supplied in parallel with controlled pressure.

In the embodiments illustrated, each pressure unit 21 comprises a rod 22 with a ferrule 23, for support against the lower surface of the table 20, which pivots around a pin 24. The rod 22 is guided inside a vertical cylindrical guide 25, and is provided with a directional cylindrical stop 26 inside the guide. A calibrated thrust spring 27, which is disposed between the base of the guide 25 and the stop 26, thrusts the rod 22 upwards, and forces the table 20 to rotate around its pin 24, thus compressing the layer of fibres which is above, against the roller 30.

On each rod 22, there is provided a level indicator 28; a corresponding level sensor 40*a–d*, for each rod, detects the corresponding signal, which provides the information concerning the angular position assumed by the table, i.e. the thickness of each of the gaps between the rollers 30 and tables 20.

Each sensor 40*a–d* is connected by means of a line 41*a–d* to the machine control unit 42. This in turn is connected by means of the lines 43*a–d* to the inverters 44*a–d*, which control the motors 37*a–d*, which actuate the rollers 30*a–d*, by means of the connections 45*a–d*.

In fact, each of the rollers 30*a–d* is positioned at its own table 20*a–d*, and is mounted idle on a common fixed shaft 31, with corresponding bearings interposed. The shaft 31 is connected to the frame of the machine. According to a preferred embodiment of the invention, the rollers are machined with a lobar winding surface, in order to obtain a more efficient grip on the mat of fibres 15, which is conveyed into the gap between the roller 30 and the table 20. The rollers 30*a–d* are provided with individual rotational drive, at a speed which is controlled roller by roller, according to the command obtained from the control unit 42 of the machine.

In the embodiments which are illustrated by way of example in the figures, this rotational drive is provided by means of clutch discs, which are driven by their own motor, by means of a belt and pulley connection, however this drive can be produced by equivalent means, for example by motors which are disposed in line with the discs themselves.

Figure 3:
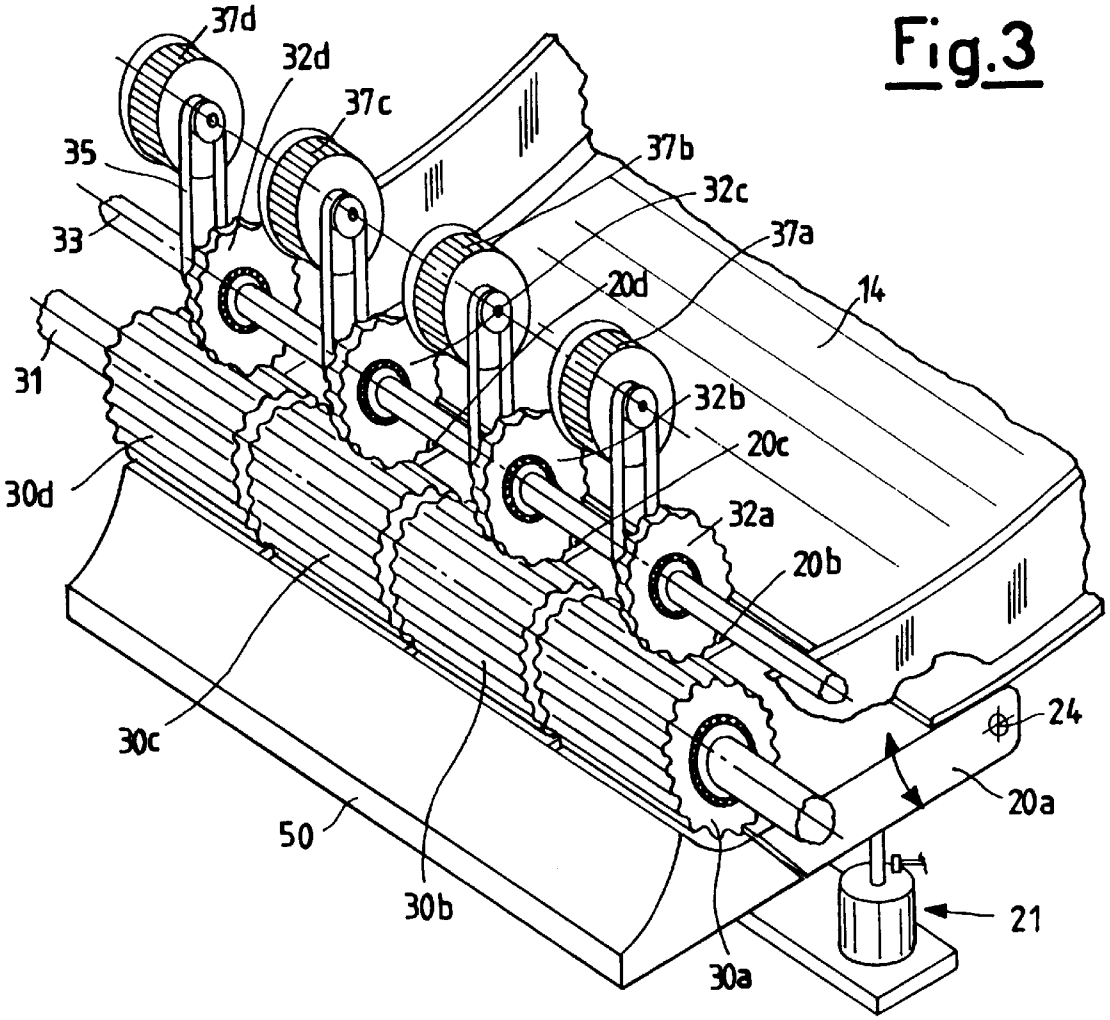
FIG. 3 illustrates a perspective view of an alternative embodiment of a carder according to the present invention.

According to the embodiments illustrated in FIGS. 2 to 4, the drive is provided by a series of clutch discs 32*a–d*, one for each roller 30*a–d*, which disc is positioned at its own roller, and is mounted idle on a common fixed shaft 33, which is connected to the frame of the machine. According to a preferred embodiment of the invention, the clutch disks are machined with a lobar winding surface, which is compatible with that of the rollers 30, in order to obtain more efficient drive on the rollers themselves.

Figure 5:
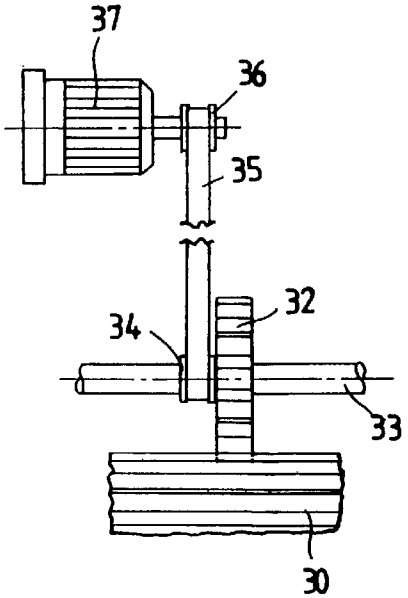
FIG. 5 illustrates a partial front view of a pulley system for the rollers according to the present invention.

Each of the clutch discs 32*a–d* is provided with a pulley 34, which is integral with it, and coaxial relative to it, as shown in the detail in FIG. 5. This pulley 34 is connected by a drive belt 35 to the rotary end pulley 36 of the individual drive motor 37 of the corresponding roller 30*a–d*, in the individual kinematic chain which is provided for each of the four gaps between each table 20 and roller 30.

In the alternative embodiment which is illustrated in FIG. 3, the structure of the table 20, which creates the gap for passage of the fibres conveyed to the carder, is modified, whereas the remaining parts of the device are unchanged. FIG. 4 illustrates this different, modified table structure, as well as the detail of the pressure unit 21 and the position of the taker-in 18, which receives the fibres conveyed to the carder.

On the other hand, the table 20 in the preceding embodiment according to FIG. 2 is subdivided into two parts, i.e. an initial mobile part, still indicated as 20, which is subdivided by way of example into four elements 20*a–d*, and pivots around the pin 24, and a final part 50, which is fixed and not necessarily subdivided. This final part 50 is disposed on the side adjacent to the taker-in 18, and is connected to the structure of the machine, such as to ensure in the end part 51 of the fibre conveyor gap, that the brush of fibres 52 which is presented to the lining 18' of the taker-in 18, is always gripped in the same manner, at the same distance, and in the same direction. The thickness of the initial part of the gap can thus be modulated by the quantity of fibre which is present in it moment by moment, whereas the configuration of its final part is not altered.

In order to illustrate the characteristics of the device according to the invention, its functioning and the method of supply which it provides are described in general.

The mat of fibres 15 is obtained from the pair of lobar rollers 13 which rotate at a controlled speed, it descends along the slide 14, and is gripped between the pivoting tables 20 and the rollers 30. If the transverse dimension of the mat is irregular in one of the gaps between the table and the roller, as a result of a lack or excess of fibres, the configuration of the table concerned is altered. In general, the range of modulation of the gap between the table 20 and the roller 30 is within an interval of ±4 mm, and preferably ±2 mm.

If there is a lack of fibres at one or more of the gaps between the tables and rollers, the mat 15 has lower resistance to the thrust from beneath, by the pressure unit 21; the pressure unit predominates, and thrusts upwards its own table, thus limiting the gap in a manner which is proportional to the quantity of fibres $m_{a-d}$ present in the gap moment by moment. The sensor 40 detects and transmits to the control unit of the machine 42 the signal relating to the reduced quantity $m_{a-d}$ of fibres present between the roller 30*a–d* and the table 20*a–d* concerned. On receipt of this signal, the control unit 42 of the carder controls the inverter 44*a–d* of the motor 37*a–d*, in order to impart to each roller 30*a–d* an increase in its speed $v_{a-d}$, such as to maintain constant the output by weight which passes through each gap, i.e. to maintain constant the product $m_{a-d}$, $v_{a-d}$ which corresponds to a value of output by weight which is allocated equally to each of the gaps. The linear speed which is transmitted by the roller 30 to the fibres is controlled in a manner which is inversely proportional to the quantity of fibres present in its gap, moment by moment. If, for example, the thickness of this gap is reduced to half the reference value, the corresponding roller 30 is rotated at a rotational speed which is twice the reference value, such as to double the speed of feed of the mat 15 in the section concerned.

In the opposite case, of an excess of fibres, the mat 15, which is gripped by its roller 30, has an increased consistency, and thrusts downwards the slider 22 of the pressure unit 21: the mat predominates, and moves downwards its own table, thus widening the gap, against the resistance of the spring 27. The sensor 40 detects and transmits to the control unit of the machine 42 the signal to increase the gap, owing to the increased quantity $m_{a-d}$ of fibres present between the roller 30*a–d* and the table 20*a–d* concerned. On receipt of this signal, the control unit 42 of the carder controls the inverter 44*a–d* of the motor 37*a–d*, in order to impart to each roller 30*a–d* concerned a decrease in its speed $v_{a-d}$, such as to maintain constant the output by weight which passes through each gap, i.e. the constant management criterion continues to be that of allocating and maintaining unvaried over a period of time the product $m_{a-d}$ $v_{a-d}$ in each of the gaps between each pivoting table 20*a–d* and the corresponding roller 30*a–d*: the linear speed $v_{a-d}$ of the roller is thus controlled in a manner which is inversely proportional to the quantity $m_{a-d}$ of fibres present in its gap, moment by moment.

According to the embodiment illustrated so far by way of example, the rollers 30 are disposed above the tables 20, in order to form the regulation gaps. The opposite arrangement is equivalent, and constitutes an alternative embodiment of the invention.

By means of this arrangement, which is substantially overturned relative to the preceding arrangement, the device for supply to a carder has the slide 14 which ends by overlapping the feed roller unit 30*a–d* beneath, which is opposite the superimposed unit consisting of a plurality of pivoting tables 20*a–d*, which are aligned transversely, and have the same transverse dimension. The regulation gaps are thus formed; the rollers 30*a–d* are also provided with means for individual, continuous regulation of the speed, according to the quantity of fibres present in the gap which corresponds to the rollers; each of the tables 20*a–d* is provided with a superimposed pressure unit 21*a-d*, which thrusts its own table against the corresponding lower roller 30*a–d*, with controlled force. With each table 20*a–d*, there is associated a sensor 40*a–d*, which supplies a signal relative to the angular position assumed by the table 20*a–d*, i.e. relative to the thickness of each of the gaps between the rollers 30*a–d* and tables 20*a–d*, according to the quantity of fibres present in the gap which corresponds to the table.

The control unit 42 of the machine carries out a plurality of functions, receiving signals from a plurality of other sensors, and controlling its own miscellaneous units. For example, the signals which are received from the plurality of sensors 40*a–d* are further processed in the machine control unit 42, and, on the basis of the overall flow of fibres of the mat 15 which is detected moment by moment, the control unit also controls the drive of the cylinder 5 which supplies the second chamber 8, via the connection of the line 55, in order to regulate the average density of the fibres which reach the slide 14.

By means of the device according to the present invention, substantial advantages are obtained, of which at least the following should be mentioned.

The device can carry out continuous automatic adjustment of the carder, with a weight of fibre which is constant over a period of time, thus limiting the oscillations of density of the strip, and providing a high level of regularity of the yarn count, with values of $CV_t$ % which can be restricted to 0.5–0.8% on samples of 10 m, in which CV generally indicates the Coefficient of Variation.

The fibrous mass which is supplied to the carder is distributed homogeneously along the entire width of the lined cylinders, and is subjected to the same intensity of processing for opening of the flock, and reduction of the neps. The transverse cross-section of the strip obtained is very regular, and is independent of its irregular density upstream from the machine.

On the fixed and mobile lines surfaces of the carder, there is no accumulation of dirt and irregular clogging, which would accentuate the transverse differences of the strip, and nor is there irregular wear.

What is claimed is:

1. A device for supply of a mat of fibers to an input cylinder of a carder, said device comprising:

a slide configured to receive the mat of fibres;

a plurality of pivoting tables aligned transversely, said slide having an end that overlaps said plurality of pivoting tables, said plurality of pivoting tables being disposed transversely so as to form first gaps therebetween;

a set of feed rollers having a same transverse dimension as said plurality of pivoting tables, said plurality of pivoting tables being positioned opposite said set of feed rollers, said set of feed rollers being superimposed over said plurality of pivoting tables such that a second gap is formed between said set of feed rollers and said plurality of pivoting tables; and a mechanism configured to provide individual, continuous regulation of rotational speed to said set of feed rollers according to a quantity of fibres present in the second gap, wherein said plurality of pivoting tables are each provided with an underlying pressure unit that is configured to thrust a corresponding pivoting table with controlled force against a corresponding feed roller, and said plurality of pivoting tables are each provided with a level sensor that is configured to supply a signal corresponding to an angular position of a respective pivoting table based upon a quantity of fibres present in the second gap.

2. The device according to claim 1, characterised in that each level sensor is connected to a control unit which in turn is connected to inverters, which control motors that drive the set of feed rollers.

3. The device according to claim 1, characterised in that the plurality of pivoting tables are subdivided into two parts: an initial, mobile part which is subdivided into a plurality of elements that pivot around a pin, and a fixed, final part that is secured and disposed on a side adjacent to the, input cylinder such that a thickness of the second gap at the initial part between the plurality of pivoting tables and the set of feed rollers can be modulated, whereas the configuration of the final part is not modified.

4. The device according to claim 1, characterised in that the set of feed rollers are machined with a lobar winding surface.

5. The device according to claim 1, wherein the plurality of pivoting tables and the set of feed rollers are provided in corresponding pairs of pivoting tables and feed rollers with adjustable gaps therebetween, and the corresponding pairs number in a range from 3 to 8 pairs.

6. Device for supply of a mat of fibres to a carder, which mat is released by a set of discharge cylinders, which conveys the fibres onto a slide, which supplies the fibres to the device for supply to the taker-in cylinder of a carder, characterised in that the slide ends by overlapping an underlying set of feed rollers, which is opposite a plurality of superimposed, pivoting tables, which are aligned transversely and have the same transverse dimension, such as to form between one another a plurality of gaps, the rollers being provided with means for individual, continuous regulation of the speed, according to the quantity of fibres present in the gap which corresponds to the rollers; each of the tables is provided with a superimposed pressure unit, which thrusts its own table with controlled force against the corresponding lower roller; with each table there is associated a sensor, which supplies a signal corresponding to the angular position assumed by the table based upon a quantity of fibres present in the gap between the roller and the table.

7. A method for supply of a mat of fibres to a carder using a device for supply of a mat of fibers to an input cylinder of a carder, the device including a slide configured to receive the mat of fibres; a plurality of pivoting tables aligned transversely, the slide having an end that overlaps the plurality of pivoting tables, the plurality of pivoting tables being disposed transversely so as to form first gaps therebetween; a set of feed rollers having a same transverse dimension as the plurality of pivoting tables, the plurality of pivoting tables being positioned opposite the set of feed rollers, the set of feed rollers being superimposed over the plurality of pivoting tables such that a second gap is formed between the set of feed rollers and the plurality of pivoting tables; and a mechanism configured to provide individual, continuous regulation of rotational speed to the set of feed rollers according to a quantity of fibres present in the second gap, wherein the plurality of pivoting tables are each provided with an underlying pressure unit that is configured to thrust a corresponding pivoting table with controlled force against a corresponding feed roller, and the plurality of pivoting tables are each provided with a level sensor that is configured to supply a signal corresponding to an angular position of a respective pivoting table based upon a quantity of fibres present in the second gap, said method comprising the step of:

controlling rotational speed of each roller of the set of feed rollers in order to maintain a final product ($m_{a-d}$ $v_{a-d}$) constant, corresponding to a value of output by weight allocated for the second gap, a linear speed ($v_{a-d}$) which is transmitted by the set of feed rollers to the fibres being controlled in a manner which is inversely proportional to the quantity which is measured moment by moment, of fibres ($m_{a-d}$) present in the second gap.

8. Method according to claim 7, characterised in that a control unit controls moment by moment an inverter of a motor used to drive the roller, in order to impart to each roller an increase in its speed ($v_{a-d}$), corresponding to a decrease of the quantity measured of fibres ($m_{a-d}$) present in the second gap.

9. Method according to claim 7, characterized in that a control unit processes the signal received by the level sensors and, on the basis of a flow of fibres as a whole detected moment by moment in the mat, controls the drive of a supply cylinder in order to regulate an average density of the fibres which reach the slide.

* * * * *